US011786056B2

(12) United States Patent
Beghtel

(10) Patent No.: US 11,786,056 B2
(45) **Date of Patent: *Oct. 17, 2023**

(54) CRIB COVER

(71) Applicant: Sweet Dreams Cover LLC, Cobbs Creek, VA (US)

(72) Inventor: Brandi E. Beghtel, Hartfield, VA (US)

(73) Assignee: Sweet Dreams Cover LLC, Cobbs Creek, VA (US)

( * ) Notice: Subject to any disclaimer, the term of this patent is extended or adjusted under 35 U.S.C. 154(b) by 21 days.

This patent is subject to a terminal disclaimer.

(21) Appl. No.: 17/352,486

(22) Filed: Jun. 21, 2021

(65) Prior Publication Data

US 2021/0386211 A1 Dec. 16, 2021

Related U.S. Application Data

(63) Continuation of application No. 15/895,490, filed on Feb. 13, 2018, now Pat. No. 11,045,013.

(51) Int. Cl.

| | |
|---|---|
| ***A47C 29/00*** | (2006.01) |
| ***A47D 7/00*** | (2006.01) |
| ***A47C 31/10*** | (2006.01) |
| ***A47D 13/06*** | (2006.01) |
| ***A47D 9/00*** | (2006.01) |

(52) U.S. Cl.

CPC ..... *A47C 29/003* (2013.01); *A47C 31/10* (2013.01); *A47D 7/00* (2013.01); *A47D 9/00* (2013.01); *A47D 13/06* (2013.01)

(58) Field of Classification Search

CPC ..... A47C 29/003; A47C 31/10; A47D 7/00; A47D 13/06; A47D 9/00

See application file for complete search history.

(56) References Cited

U.S. PATENT DOCUMENTS 2,586,247 A * 2/1952 Mover ..... A47D 9/005 5/97
2,958,084 A * 11/1960 Kenney ..... A47D 13/063 5/98.1
4,015,297 A 4/1977 Christian
(Continued)

OTHER PUBLICATIONS

The Stork Nest, SnoozeShade for Travel Cots and Standard Cots, Jun. 10, 2015, Video Link: https://www.youtube.com/watch?v=WynJ6VfMSso&feature=youtu.be&t=178 (Year: 2015).*

*Primary Examiner* — David R Hare
*Assistant Examiner* — Adam C Ortiz
(74) *Attorney, Agent, or Firm* — Blank Rome LLP

(57) ABSTRACT

A cover for an infant confining device having a bottom, four sides, and an open top is described. The cover includes a body formed of a dark stretchable material and having at least one side with a top and bottom portion. The body is configured to stretch around the four sides of the infant confining device such that the top portion extends over the open top and the bottom portion extends to the bottom. The cover includes a roof flap of dark non-stretchable material with four sides. One side of the roof flap is coupled with the top portion of the body while the rest are unattached and larger than the infant confining device. The unattached sides of the roof flap drape over the top portion of the at least one side of the body and respective sides of the infant confining device.

12 Claims, 7 Drawing Sheets

(56) References Cited

U.S. PATENT DOCUMENTS

| | | | | |
|---|---|---|---|---|
| 5,862,548 | A * | 1/1999 | Gerhart | A47D 13/06 135/117 |
| 9,186,972 | B1 | 11/2015 | Holeman et al. | |
| 11,045,013 | B2 * | 6/2021 | Beghtel | A47D 15/005 |
| 2005/0005362 | A1 * | 1/2005 | Verbovszky | A47D 13/02 5/655 |
| 2007/0257526 | A1 * | 11/2007 | Hei | A47D 15/00 297/184.13 |
| 2008/0141457 | A1 | 6/2008 | Forshpan | |
| 2018/0055241 | A1 | 3/2018 | Mallory et al. | |

* cited by examiner

CRIB COVER

TECHNICAL FIELD

This disclosure relates generally to an infant confining device cover, and more specifically to a universal shading cover for infant confining devices such as play pens, cribs, and the like.

BACKGROUND

Infant confining devices are used to keep an infant or small child, generally under about the age of 4, in a confined space so the child may sleep or play safely. In general, infant confining devices include cribs, play pens, play yards and infant devices. FIG. 1 illustrates an example infant confining device 100 of the prior art. This example infant confining device 100 has a bottom 118, a frame with four posts, four feet 116, four side walls 112, 114 with an upper edge, and an open top 110. The bottom 118, four side walls 112, 114, and the open top 110 define an area where the child can rest, sleep, or play. Infant confining devices are usually rectangular, as shown, with two opposing longer longitudinal sides 114 and two opposing transverse sides 112. As may be seen with example infant confining device 100, the open top 110 allows a great deal of light into the interior. If the child needs to rest, the example infant confining device 100 alone is limited in how dark an environment it can provide. If the child needs protection from insects, example infant confining device 100 alone is limited in the amount of insect protection it can provide. The cover for an infant confining device supplies the deficiencies of example infant confining device 100 alone.

Some infant confining devices sit directly on the floor and others are raised off the floor by feet. In this way, parents or caretakers carefully control the child's environment, allowing for safe play or quiet sleep. Some infant confining devices are portable for travel convenience and may collapse or detach into a smaller, more easily moved configuration. Other infant confining devices are rigid for home use.

SUMMARY

The present invention describes a cover for infant confining devices and may be used for both travel and at-home use infant confining devices. The cover may be especially suited for travel when it may be particularly difficult to find a dark or shaded place for the child to rest. The cover may also be used as part of an outdoor infant confining device, to provide shade from direct sunlight as well as insect protection.

Embodiments of this disclosure pertain to one or more systems for shielding a child in an infant confining device from unwanted light and insects. A stretchy, close mesh fabric surrounds the side walls of the infant confining device such that air continues to circulate through to the inside, but blocks a portion of light to shade the inside. A roof flap over the top of the infant confining device may be opened to allow the child to be placed inside and closed to act as a roof, further darkening the interior and providing insect protection. In some embodiments, the roof flap may be separated from the cover on three sides and attached to the walls of the cover by a zipper on the fourth side, allowing the roof flap to be removed as needed.

BRIEF DESCRIPTION OF THE DRAWINGS

For the purpose of illustration, there are shown in the drawings certain embodiments described in the present disclosure. In the drawings, like numerals indicate like elements throughout. It should be understood that the full scope of the inventions disclosed herein are not limited to the precise arrangements, dimensions, and instruments shown. In the drawings.

DETAILED DESCRIPTION

Reference will now be made in detail to implementations of the technology. Each example is provided by way of explanation of the technology only, not as a limitation of the technology. It will be apparent to those skilled in the art that various modifications and variations can be made in the present technology. For instance, features described as part of one implementation of the technology can be used on another implementation to yield a still further implementation. Thus, it is intended that the present encompass such modifications and variations.

Figure 1:
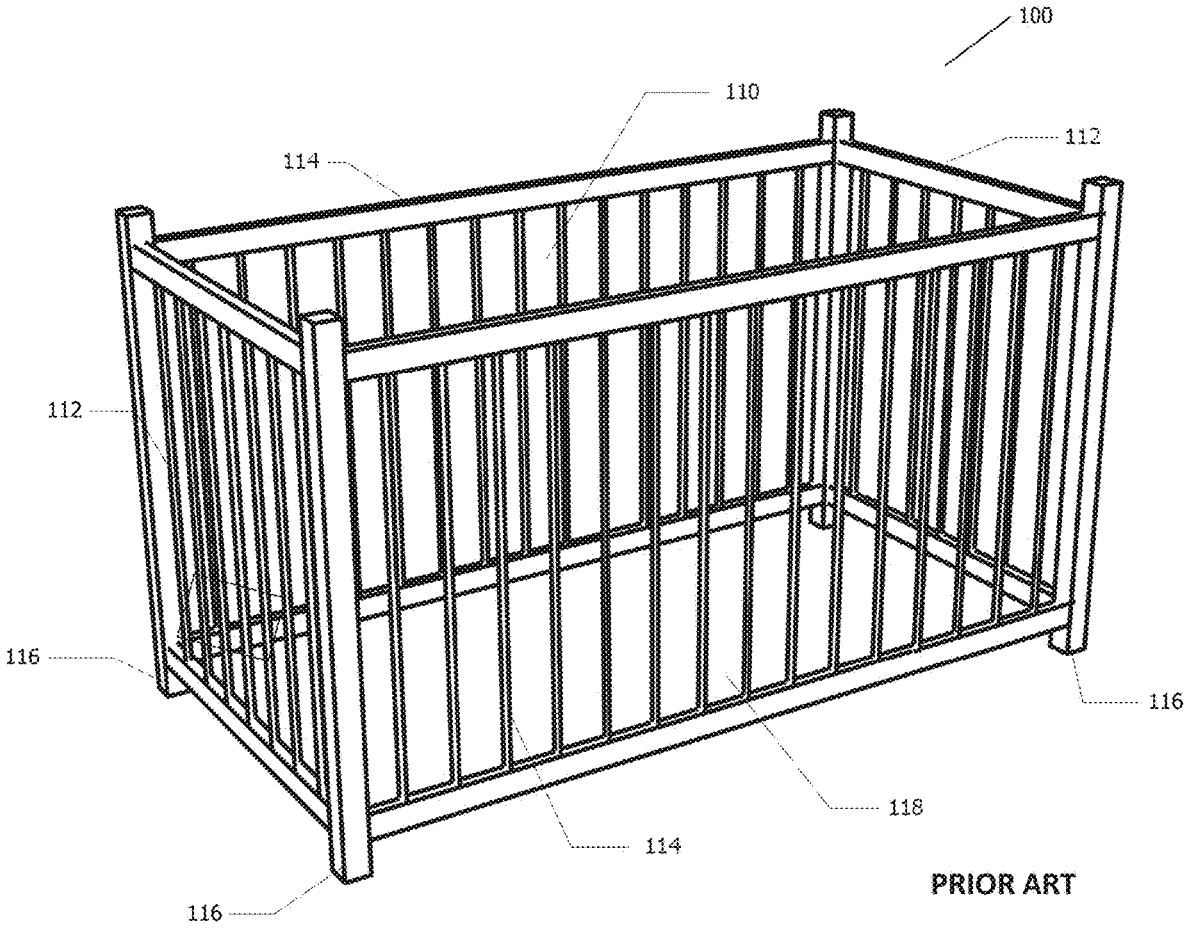
FIG. 1 illustrates an example infant confining device, according to the prior art.
Figure 2:
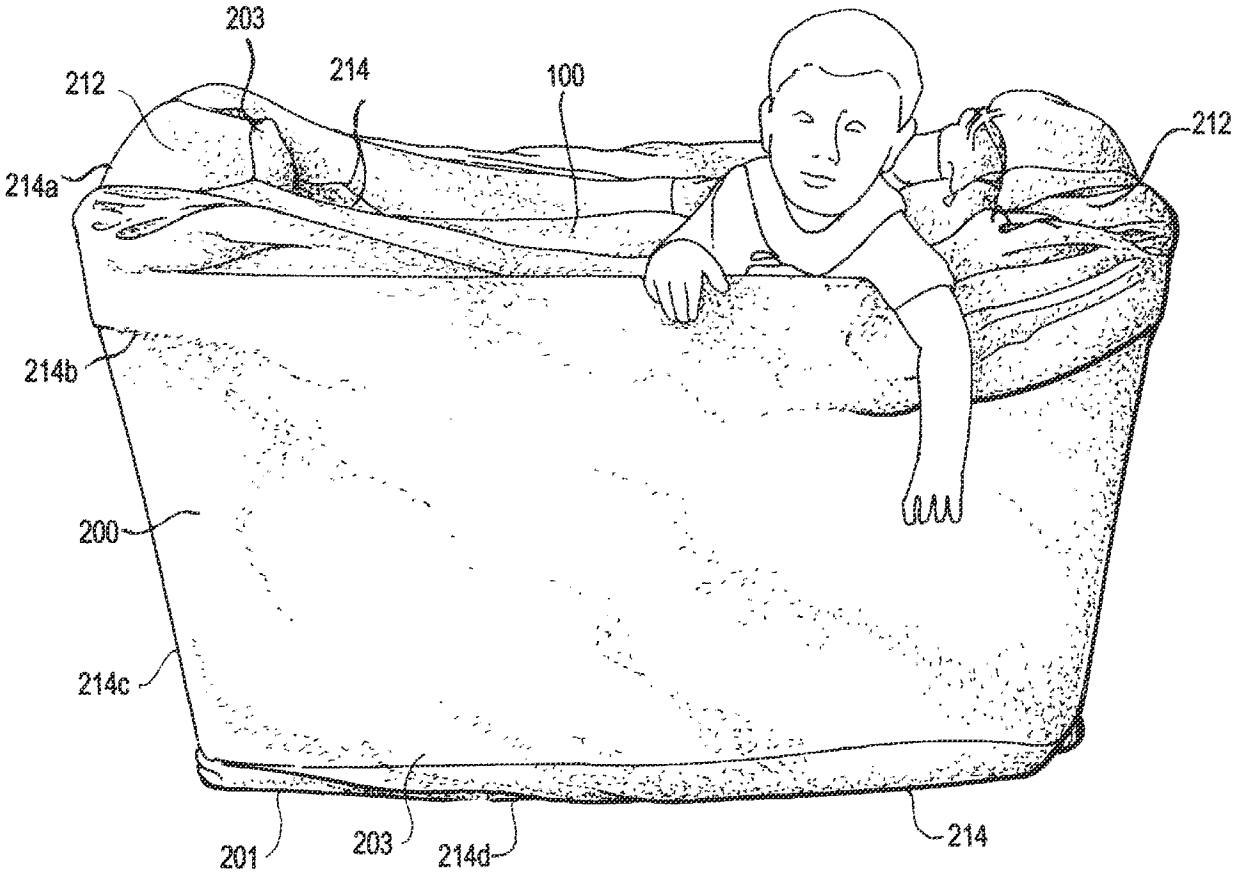
FIG. 2 illustrates a cover for an infant confining device, according to one embodiment.

FIG. 2 illustrates a cover 200 according to one embodiment of the invention, fitted over an infant confining device 100. The cover 200 includes a body 201 and optional elastic retention bands 203. The body 201 has four side walls or side wall 212, 214, all having interior and exterior surfaces and a top portion, bottom portion, upper edges and lower edges. For example, FIG. 2 shows the upper edge 214*a* of side wall 214, the top portion 214*b*, the bottom portion 214*c*, and the lower edge 214*d*. The side walls 212, 214 are all attached to form a single integrated unitary body 201 in the general shape of a rectangle. Where, as shown in FIG. 2, the infant confining device 100 is rectangular, the cover 200 includes two opposing longer longitudinal sides 214 and two opposing transverse sides 212 to cover sides 112, 114 of infant confining device 100. The four side walls may be made of any dark material, such as for example 2-4 opacity rating (with 1 being "maximum opaqueness" and 5 being "transparent"), flexible, stretchable material. The side walls 212, 214 are taller than the infant confining device 100, allowing excess fabric from the top portion and upper edge of the side walls, such as 214*b* and 214*a*, to partially extend over and into the open top 110 or from the bottom portion and lower edges of the side walls, such as 214*c* and 214*d*, optionally to be tucked under the feet 116.

The body 201 is configured so that the upper and lower portions 214*b* and 214*c* of the cover 200 extend over the top and bottom of the infant confining device 100. For instance, the body 201 is smaller than the device 100 so that it has to be stretched over and around the device 100. That way, when the cover 200 is placed over the device 100, the upper and lower portions 214*b* and 214*c* of the cover 200 extend inward over the top and bottom of the device 100. This engages the cover 200 to the device 100 so that the cover 200 can completely surround the device 100. In addition, elastic bands 203 can be provided at the upper and lower edges of the body 201 to further draw the upper and lower portions 214*b* and 214*c* inward and hold the cover in place on the device 100.

The sides 212, 214 of the cover 200 completely surround the four side walls 112, 114 of the infant confining device 100 to darken the inside area of the device 100. The dark fabric may be a close mesh to allow air flow inside the play pen while still blocking a substantial amount of light. The fabric can also be lightweight, soft and breathable. In some embodiments, the fabric is 50% elastane and 50% polyester, such that the fabric stretches underneath feet 116 easily. In those embodiments, the cover 200 securely attaches to the infant confining device 100 without need for any locking or attachment devices such as hooks, loops, buttons, Velcro®, ties, other child safety hazards, and the like. (Velcro® is a registered trademark owned by Velcro Industries.) Further, the fabric's stretch allows cover 200 to fit any size or style of crib, play pen, or other infant confining device 100. In this view, open top 110 of infant confining device 100 is left open and uncovered.

The cover 200 has two configurations, namely a storage configuration and an operating configuration. In the storage configuration, the cover 200 may be folded, rolled, or otherwise collapsed into a compact, easy to carry form. The storage configuration allows the cover 200 to pack easily into a small shape for travel and/or storage. In the operating configuration, the cover 200 is at least partially stretched over the infant confining device 100 to provide at least partial shade to the interior of infant confining device 100.

To operate the cover 200, the upper and lower edges of the four side walls 212, 214, such as 214*a* and 214*d*, are stretched over the open top 110 to at least partially cover the side walls 112, 114 of the infant confining device 100. To do so, for example, the user can place one transverse side 212 of the cover 200 around the transverse side 112 of the device 100, for instance by hooking the bottom portion of the cover 200, such as 214*c*, under the bottom or feet 116 and placing the top portion of the cover 200, such as 214*a*, over the upper edge of the sides 112. The user can then stretch the body 201 of the cover around the longitudinal sides 114 and to the far transverse side 112, and slide the body down over the longitudinal sides 114 and far transverse side 112. The user then hooks the bottom portion of the cover 200, such as 214*c*, under the bottom or feet 116 and places the top portion of the cover 200, such as 214*b*, over the upper edge of the sides 112, 114. Thus, the four side walls 212, 214 are at least partially stretched over the side walls 112, 114, and the cover 200 is optionally stretched over the feet 116 for secure attachment to the infant confining device 100.

Figure 3:
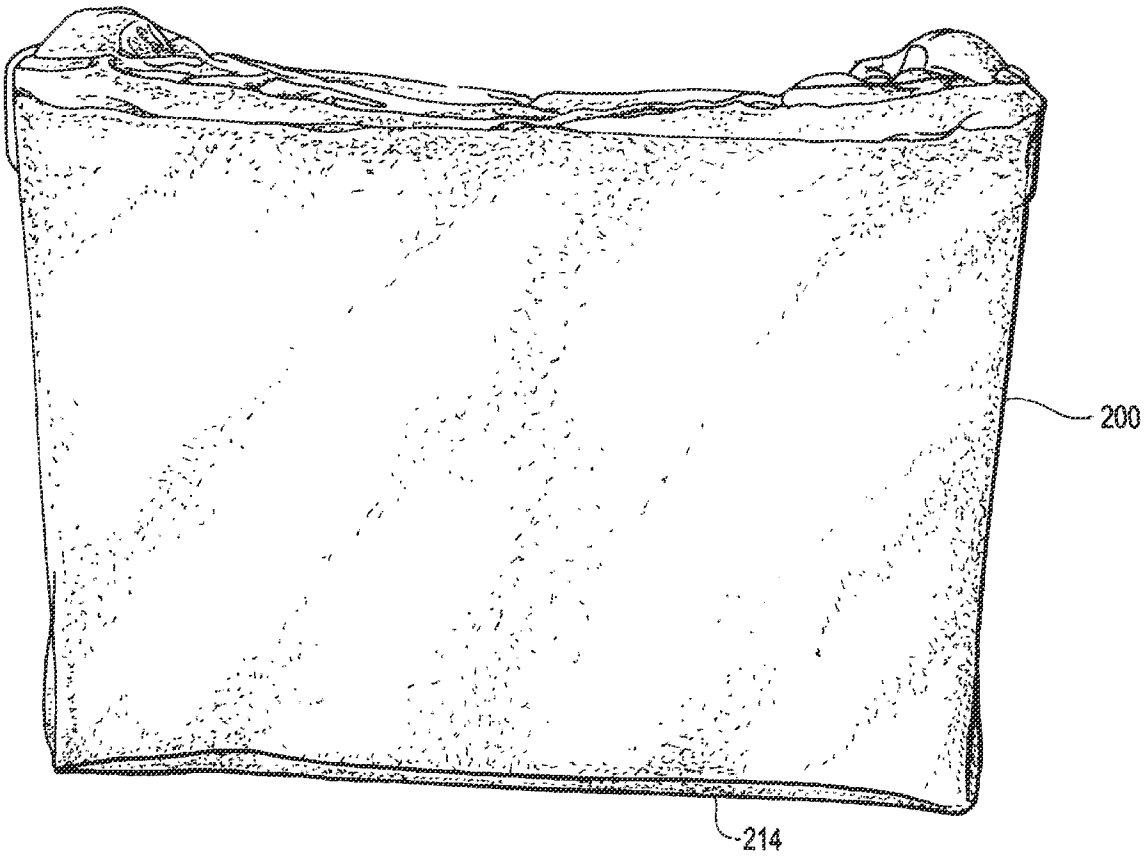
FIG. 3 illustrates a side view of a cover over the walls of an infant confining device, according to one embodiment.

FIG. 3 illustrates a side view of a cover 200 over the side walls of infant confining device 100, according to one embodiment. This view shows side wall 214 over side wall 114 of infant confining device 100. Cover 200 is stretched underneath feet 116 for secure attachment.

Figure 4:
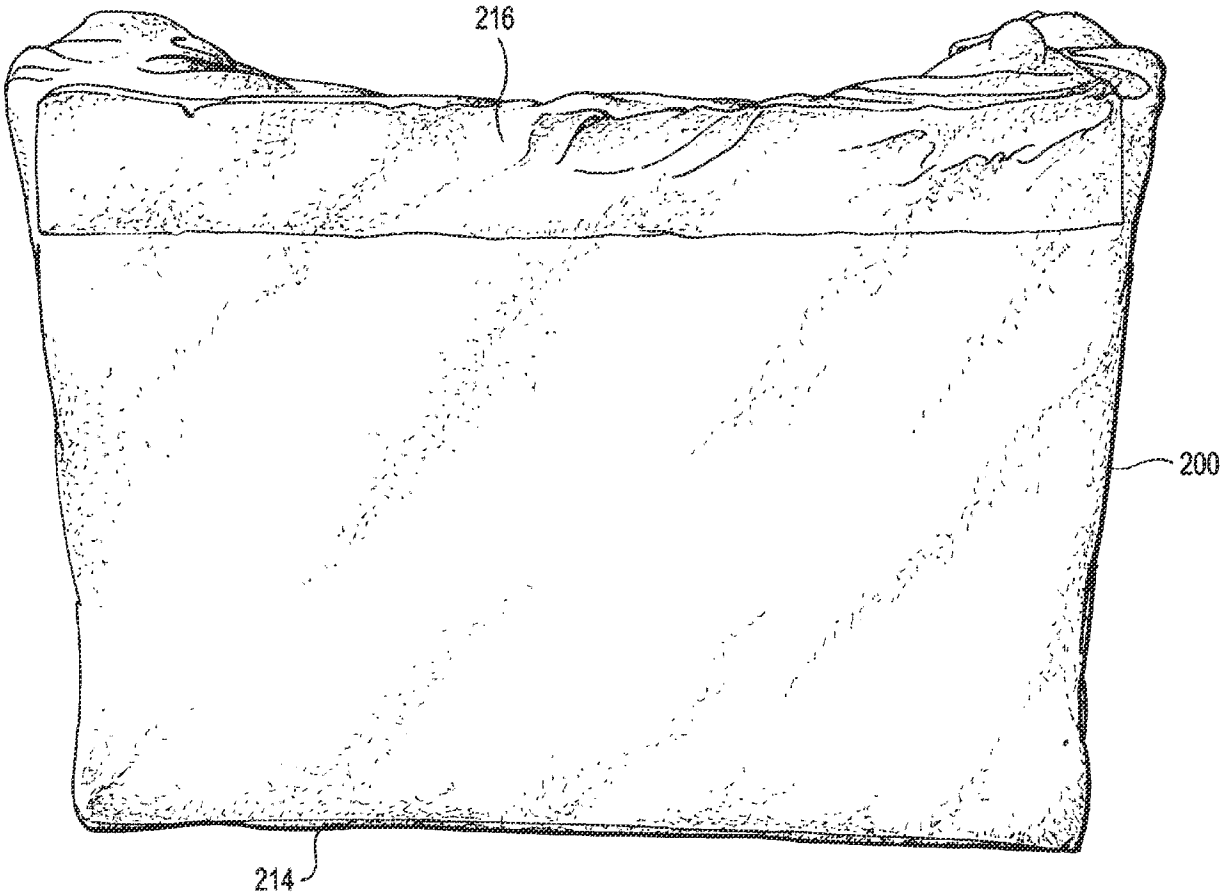
FIG. 4 illustrates another side view of a cover over the walls of an infant confining device, according to one embodiment.

FIG. 4 illustrates another side view of a cover 200 over the walls of infant confining device 100, according to one embodiment. This view shows the side wall 214 of the cover over the side wall 114 of the infant confining device 100. The cover 200 is stretched underneath the feet 116 for secure attachment.

As further shown in FIG. 4, a roof flap 216 is provided on the cover 200. The flap 216 can be generally rectangular in shape with transverse sides and longitudinal sides. The flap 216 is wider than the device 100 so it can be draped over the open top 110 of the infant confining device 100. In some embodiments, the roof flap 216 may provide additional darkening of the interior of infant confining device 100. In some embodiments, the roof flap 216 may provide insect protection for infant confining device 100 when placed outside. The top and/or distal end of the roof flap 216 can have an identifying marker, such as the child's name, embroidered into the fabric. The identifying marker may help a parent or caretaker identify the cover 200 during travel. Roof flap 216 may optionally be draped over open top 110 of the infant confining device 100 to provide additional shade or insect protection to the interior of infant confining device 100. The roof flap 216 can be made of a dark fabric, though is non-stretchable material.

Figure 5:
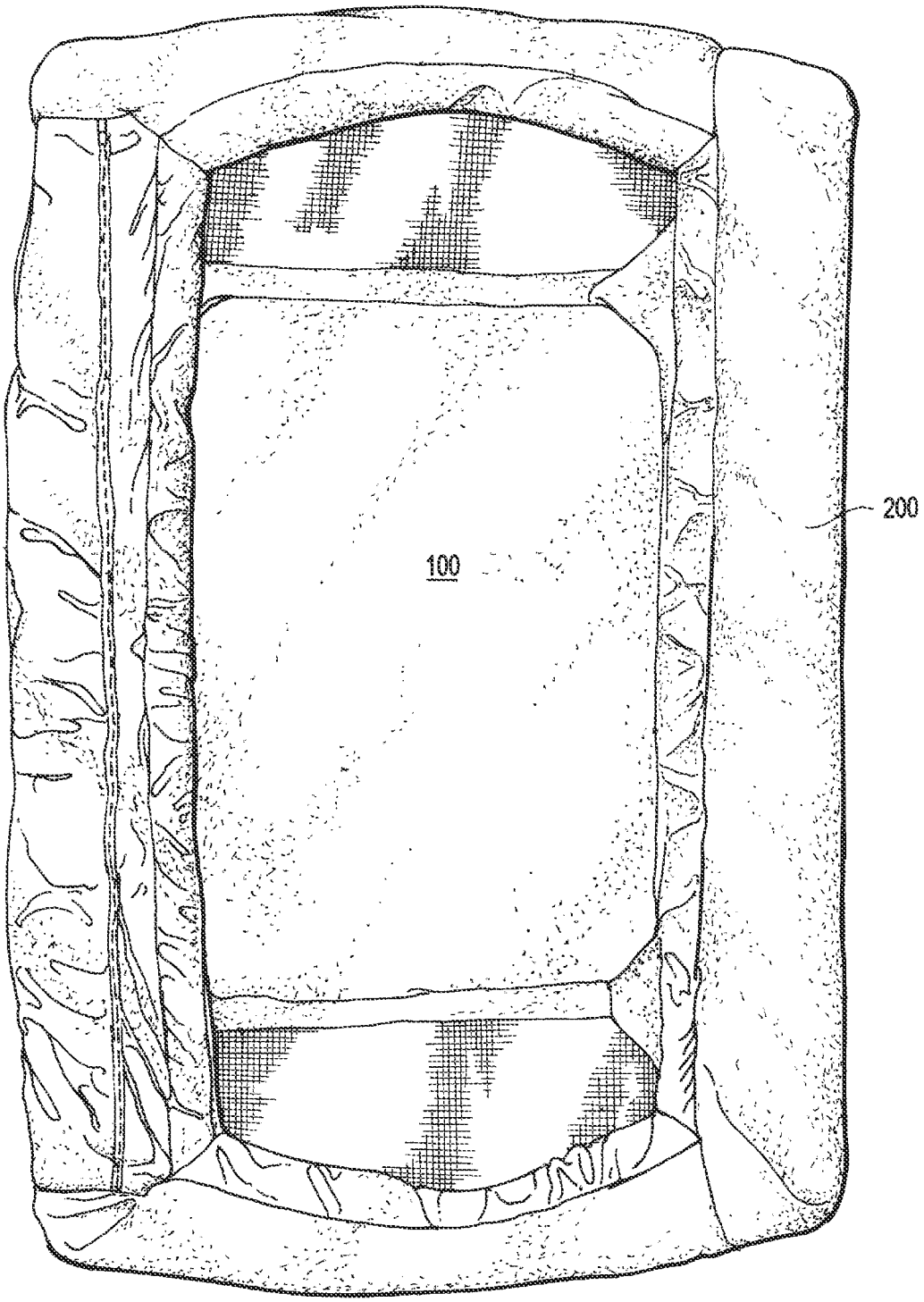
FIG. 5 illustrates a top view of a cover over the top of an infant confining device with the roof flap detached, according to one embodiment.

FIG. 5 illustrates a top view of a cover 200 over open top 110 of infant confining device 100 with roof flap 216 detached, according to one embodiment. One side of the roof flap 216 can be formed with a respective side 212, 214 of the body 201, and can be integral with the longitudinal side 214 or a separate member that is attached thereto. For example, the longitudinal side of the flap 216 can be formed with or attached to the longitudinal side 214 of the body 201. In some embodiments, roof flap 216 may be attached to cover 200 by a means of attachment, such as hooks, loops, buttons, Velcro®, ties, zippers and the like, such that roof flap 216 may be removed from the cover 200. Here, roof flap 216 is detached from the cover 200 and open top 110 is unobstructed. The flap 216 can be dark material, such as for example 2-4 opacity rating (with 1 being "maximum opaqueness" and 5 being "transparent").

When the flap 216 extends over the device 100, the entire sides and top of the device 100 are completely surrounded to provide a completely darkened inside area of the device 100. That is, the cover body 200 extends at least partially around the sides 112, 114 of the device 100, and in one embodiment completely around the sides 112, 114 of the device 100 from the top to the bottom of the device 100. And the flap 216 extends over the top of the device 100 to cover the top opening. The bottom need not be surrounded by the cover since the floor blocks light.

The flap 216 can also be a separate member that has attachments along all four sides that matably engage respective attachments positioned along the sides 212, 214 of the cover 200. For example, one or more elongated Velcro strips can be placed at the edges of the four sides of the flap 216, and elongated Velcro strips can also be placed at the top portion of the sides 212, 214 (such as inset from the upper edges) and aligned to mate with each other when the flap 216 is placed over the sides 212, 214 of the body 200. Still further, one side of the flap 216 can be integrally formed or attached (sewn) to one of the body sides 214, and the other three sides of the flap 216 can be removably attached to the body sides 212, 214. In a preferred embodiment of the invention, the flap 216 is attached along one side and the other sides are unattached from the sides 212, 214 and simply draped over the sides 212, 214 so that the child can easily open the flap 216 and is not locked inside the device 100.

Figure 6:
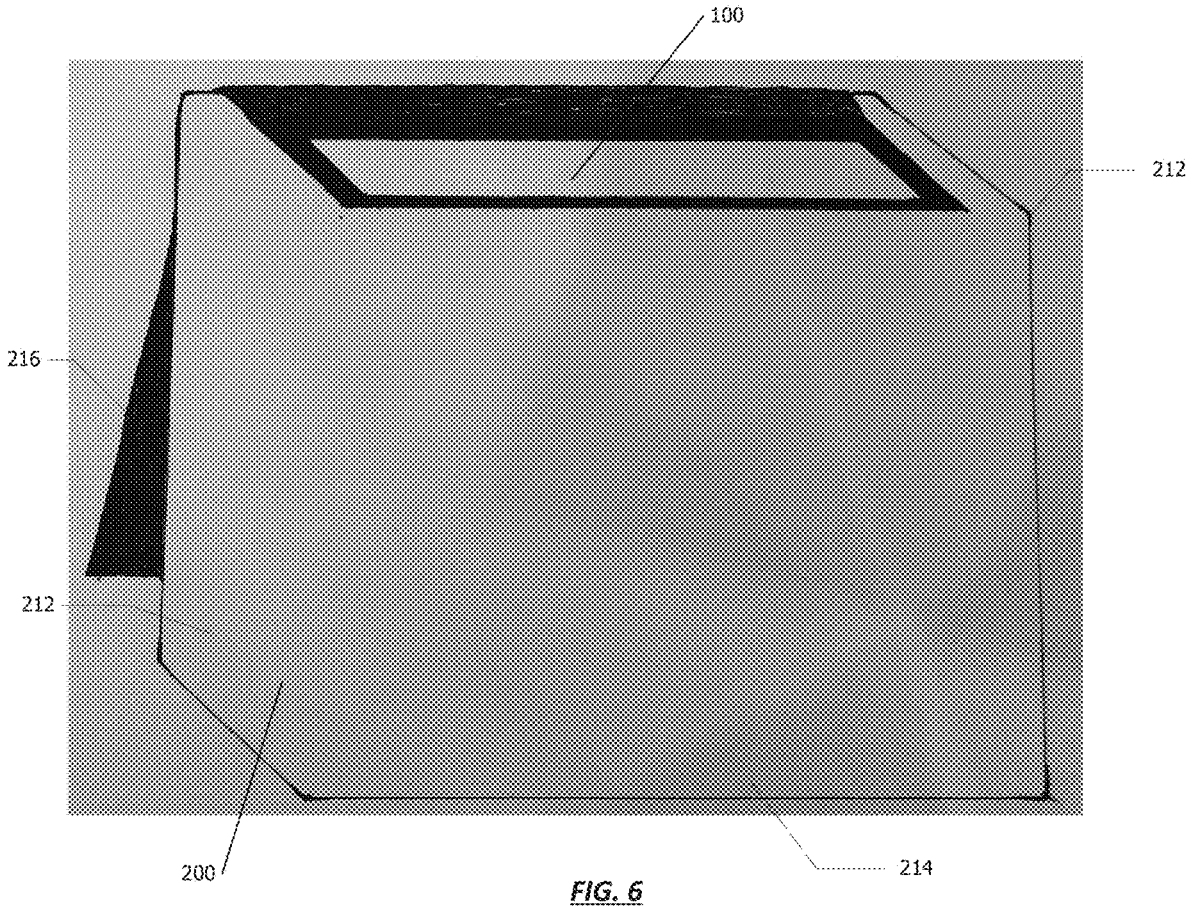
FIG. 6 illustrates a drawing of a cover over the walls of an infant confining device with the roof flap attached, but not covering the opening of the infant confining device, according to one embodiment.

FIG. 6 illustrates a drawing of a cover 200 over the side walls of infant confining device 100 with roof flap 216 attached, but not covering open top 110, according to one embodiment. In some embodiments, roof flap 216 may be attached to the cover 200 with a zipper and removed from cover 200 as needed. In this view, roof flap 216 is attached but not draped over and obstructing open top 110 of infant confining device 100.

Figure 7:
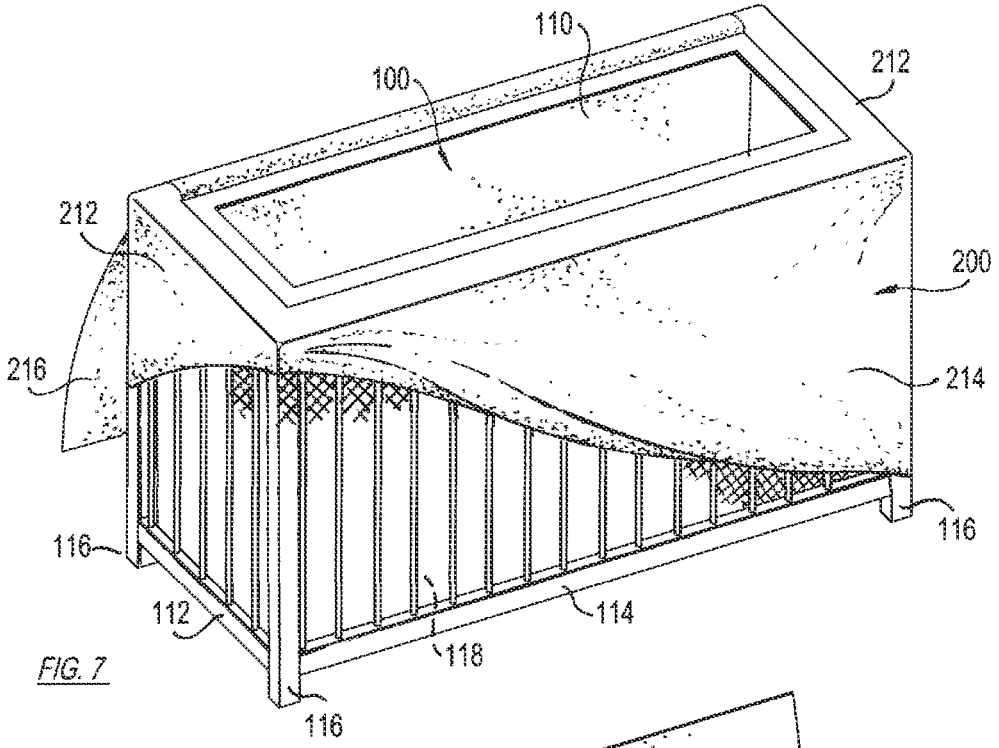
FIG. 7 illustrates a drawing of a cover over some, but not all, of the walls of an infant confining device with the roof flap opened, according to one embodiment.

FIG. 7 illustrates a drawing of cover 200 over some, but not all, of the side walls of infant confining device 100 with roof flap 216 opened, according to one embodiment. Here, side walls 212 and 214 are not stretched under feet 116, leaving side walls 112 and 114 exposed. This view highlights the utility of cover 200 to provide complete or partial darkening of infant confining device 100. Cover 200 provides shade to the interior of infant confining device 100 while still allowing a child inside to see out. The sides of cover 200 may be stretched over some, but not all, of the side walls of infant confining device 100 or partially stretched over the side walls without stretching under feet 116 to cover strategic portions of the side walls to block direct light. In some embodiments, infant confining device 100 is used outside and cover 200 provides shade and insect protection to a child inside when roof flap 216 is draped over open top 110.

Figure 8:
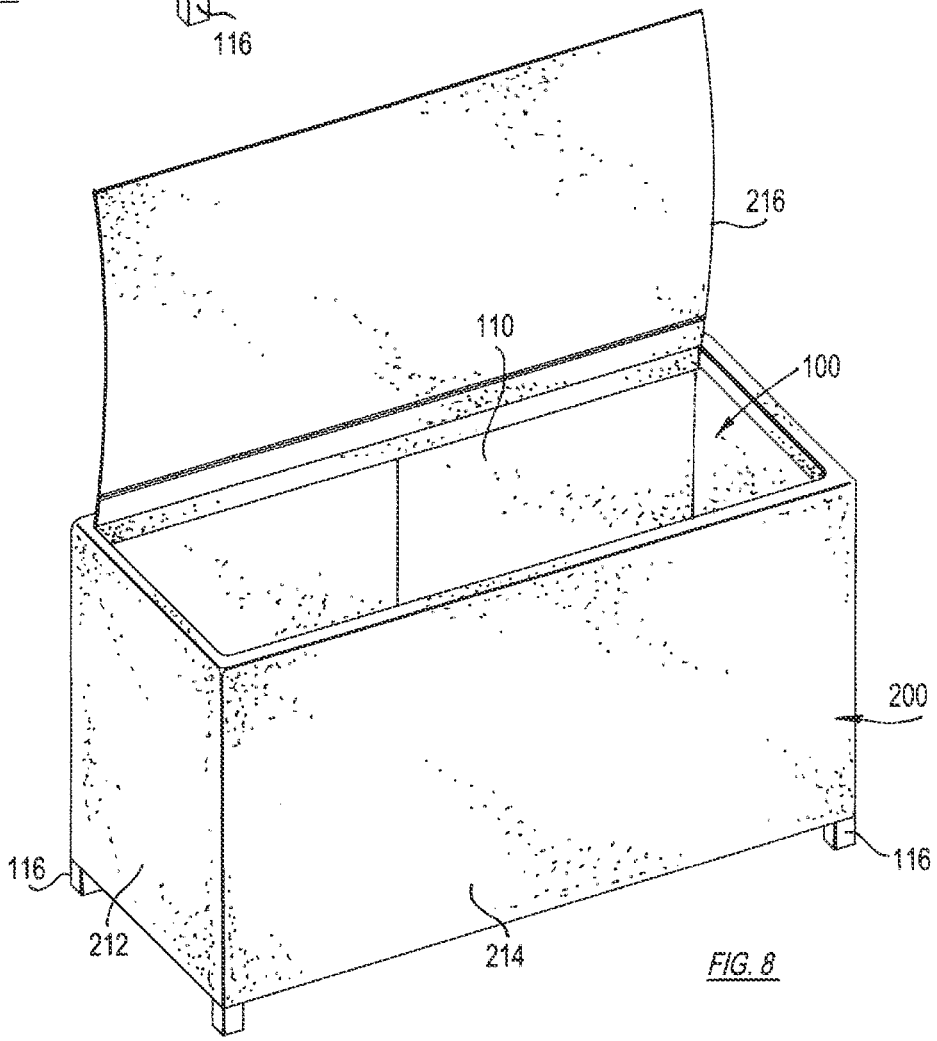
FIG. 8 illustrates a drawing of a cover according to one embodiment.

FIG. 8 illustrates a drawing of a cover 200 according to one embodiment. In some embodiments, side walls 212 and 214 of cover 200 may be made of a single, 3.5 yard long piece of black, stretch, pin dot mesh, athletic knit fabric and hemmed using a four thread overlock stitch. The top edge of side walls 212 and 214 may be bound with a satin blanket binder and hemmed with a four thread overlock stitch. Roof flap 216 may be made of doubled over rip-stop nylon in a 38 inch by 29.5 inch rectangle. Roof flap 216 may be sewn directly into the satin blanket binder seam or attached by a zipper in the satin blanket binder seam along one 38 inch long side. In some embodiments, the zipper may be a non-locking #10 finished Vision® zipper. (Vision® is a registered trademark owned by YKK Corporation.)

It is further noted that the cover 200 is shown and described as being substantially rectangular in shape. That is provided to match the shape of the infant confining device 100. It will be readily apparent that the cover 200 can be any suitable shape, such as round or square. In addition, because the cover 200 is flexible and stretches, the shape of the cover 200 need not match the shape of the device 100. In addition, though the cover 200 is described as having four sides 212, 214, it can also be described as having one continuous side (or side wall) having side portions (or side wall portions).

The invention is lightweight, yet stretchable so it can easily stretch over and around an infant confining device. So the cover 200 is easy to use, store and transport. The cover 200 can be used with all infant confining devices to provide a darkened, calm and distraction-free sleep environment for infants wherever they are, and is especially useful for travel. In addition, the material allows air to circulate in the infant confining device when in use. The cover 200 doesn't have any complicated parts or features (such as loose cords, bands, rope, string, buttons or the like) that can otherwise pose a choking hazard, and so is safe for use with an infant. The roof flap 216 is designed to simply drape over the top of the infant confining device, which is also easy to use and avoids any potential hazard. The infant is able to open the roof flap, so that the cover 200 does not trap the infant inside the infant confining device.

The various embodiments described above are provided by way of illustration only, and should not be construed so as to limit the scope of the disclosure. Various modifications and changes can be made to the principles and embodiments described herein without departing from the scope of the disclosure and without departing from the claims which follow. Any element in a claim that does not explicitly state "means for" performing a specified function, or "step for" performing a specific function, is not to be interpreted as a "means" or "step" clause as specified in 35 U.S.C. § 112, sixth paragraph.

The invention claimed is:

1. A cover for an infant confining device having a bottom, four sides side walls and an open top, the cover comprising:

a body made of a first stretchable material and configured to encircle the four side walls of the infant confining device; and a roof flap having a first edge portion that is attached or attachable to only one of the side panels of the body and a remaining edge portion, the roof flap being larger in dimension than the open top of the infant confining device such that the remaining edge portion drapes over three of the four side walls of the infant confining device, the remaining edge portion of the roof flap being unattached to the body of the cover such that the cover is configured to allow an infant or child confined inside the infant confining device to push open the roof flap, wherein the roof flap is non-stretchable.

2. The cover of claim 1, wherein:

the roof flap has a rectangular shape including the first edge portion and three additional edge portions; and each additional edge portion is unattached to the body and configured to drape over one of the four side walls of the infant confining device.

3. The cover of claim 1, wherein the roof flap is formed of a second material, wherein one or both of the first stretchable material and the second material have an opacity rating ranging from 2 to 4.

4. The cover of claim 1, wherein the roof flap is formed of a second material, wherein the first stretchable material and the second material block light from entering into an interior region of the infant confining device.

5. The cover of claim 1, wherein the first edge portion of the roof flap is formed with or attached to the one side panel of the body.

6. The cover of claim 1, wherein the body is configured to attach to the infant confining device by encircling the four side walls of the infant confining device.

7. The cover of claim 6, wherein a bottom portion of the body is configured to extend under the infant confining device.

8. The cover of claim 1, wherein the first stretchable material is a mesh fabric.

9. The cover of claim 8, wherein the mesh fabric is made of 50 percent elastane and 50 percent polyester.

10. The cover of claim 8, wherein the mesh fabric allows air to flow inside the infant confining device while blocking light from entering into an interior region of the infant confining device.

11. The cover of claim 1, wherein the body further comprises one or more elastic bands.

12. The cover of claim 1, wherein a top portion of the body is configured to extend into the open top of the infant confining device.

* * * * *